US007236074B2

(12) United States Patent
Takeyama et al.

(10) Patent No.: US 7,236,074 B2
(45) Date of Patent: Jun. 26, 2007

(54) IGNITION COIL

(75) Inventors: Shouichi Takeyama, Hashima (JP); Kazuhide Kawai, Kariya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/299,821

(22) Filed: Dec. 13, 2005

(65) Prior Publication Data

US 2006/0132271 A1 Jun. 22, 2006

(30) Foreign Application Priority Data

Dec. 21, 2004 (JP) ..... 2004-369996
Sep. 5, 2005 (JP) ..... 2005-256652

(51) Int. Cl.
*H01F 27/02* (2006.01)

(52) U.S. Cl. ..... 336/90; 336/92; 336/96

(58) Field of Classification Search ..... 336/90, 336/92, 96
See application file for complete search history.

(56) References Cited

U.S. PATENT DOCUMENTS 6,967,552 B2 * 11/2005 Aoyama et al. ..... 336/90

FOREIGN PATENT DOCUMENTS

JP 2004-63986 2/2004

* cited by examiner

*Primary Examiner*—Anh Mai
(74) *Attorney, Agent, or Firm*—Nixon & Vanderhye PC

(57) ABSTRACT

An ignition coil includes a cylindrical portion capable of being inserted into a plughole of an engine case. The cylindrical portion has a base end and a tip end, respectively, in an axial direction of the cylindrical portion. The cylindrical portion has an elastically deformable outer peripheral portion that engages with the plughole to fix an outer periphery of the cylindrical portion with respect thereto.

17 Claims, 7 Drawing Sheets

IGNITION COIL

CROSS REFERENCE TO RELATED APPLICATION

This application is based on and incorporates herein by reference Japanese Patent Applications No. 2004-369996 filed on Dec. 21, 2004 and No. 2005-256652 filed on Sep. 5, 2005.

TECHNOLOGICAL FIELD

Example embodiments of the technology described herein relate to an ignition coil for generating a spark.

DESCRIPTION OF RELATED ART

An ignition coil is mounted to an internal combustion engine of a vehicle or the like. The ignition coil is electrically connected with a spark plug to generate a spark in a combustion chamber of a cylinder. A stick type ignition coil has a cylindrical portion that is inserted into a plughole of an engine case and an igniter portion that is attached to a base end of the cylindrical portion in an axial direction of the cylindrical portion.

The cylindrical portion accommodates a primary coil and a secondary coil that are wound coaxially to each other. The igniter portion supplies the primary coil with electricity.

However, in many cases, the engine case has a variety of plugholes of different inner diameters. Therefore, when the ignition coil is mounted to the engine case, there is a possibility that a gap is formed between the cylindrical portion and the plughole. Thus, according to the size of the gap, bridge components of various sizes are used to bridge the cylindrical portion and the plughole.

In the alternative, JP-A-2004-63986, for example, discloses an ignition coil for an internal combustion engine has an insulated case that accommodates a primary coil bobbin, a secondary coil bobbin, and an iron core, wherein the wall thickness of the insulated case is thin at the side of an attachment bracket for attaching the ignition coil to the engine case and is thicker at the other side. Since the ignition coil is mounted to the engine case through the insulated case, the ignition coil may not vibrate even if a vehicle with the ignition coil vibrates.

However, in the ignition coil of JP-A-2004-63986, there is no disclosure about inserting of the cylindrical portion of an ignition coil in a variety of plugholes of different inner diameters.

SUMMARY OF EXAMPLE EMBODIMENTS OF THE INVENTION

Example embodiments of the present invention resolve the foregoing and other problems. More specifically, example embodiments of the present invention provide an ignition coil that can fix a cylindrical portion to a variety of plugholes of different inner diameters.

According to one aspect of the present invention, an ignition coil includes a cylindrical portion. The cylindrical portion includes a primary coil and a secondary coil. The secondary coil is wound coaxially with respect to the primary coil. The cylindrical portion is capable of being inserted into a plughole of an engine case of an internal combustion engine. The cylindrical portion has a base end in an axial direction of the cylindrical portion. The base end of the cylindrical portion has a built-in connector head portion that supplies the primary coil with electricity.

The cylindrical portion has a tapered outer peripheral portion. The tapered portion of the cylindrical portion has a shape, in which a thickness thereof reduces to a tip end of the cylindrical portion. The tapered portion of the cylindrical portion is fitted to an open edge of the plughole, thereby the cylindrical portion is fixed to the plughole.

Alternatively, the cylindrical outer peripheral portion has an elastic portion. The elastic portion of the cylindrical portion is capable of elastic deformation. The elastic portion of the cylindrical portion changes an outer diameter thereof by being inserted into the plughole, thereby the cylindrical portion is fixed to the plughole.

Thus, a cylindrical portion of an ignition coil can be fully fixed to a plughole without a large gap, so that the ignition coil can be certainly mounted to a cylinder of an internal combustion engine, even when a cylindrical portion is inserted to a variety of plugholes of different inner diameters.

BRIEF DESCRIPTION OF THE DRAWINGS

The present invention will be understood more fully from the detailed description given hereinafter and from the accompanying drawings of the example embodiments of the invention, which, however, should not be taken to limit the invention to these specific embodiments but are for the purpose of explanation and understanding only.

In the accompanying drawings.

DETAILED DESCRIPTION OF EXAMPLE EMBODIMENTS

Figure 1:
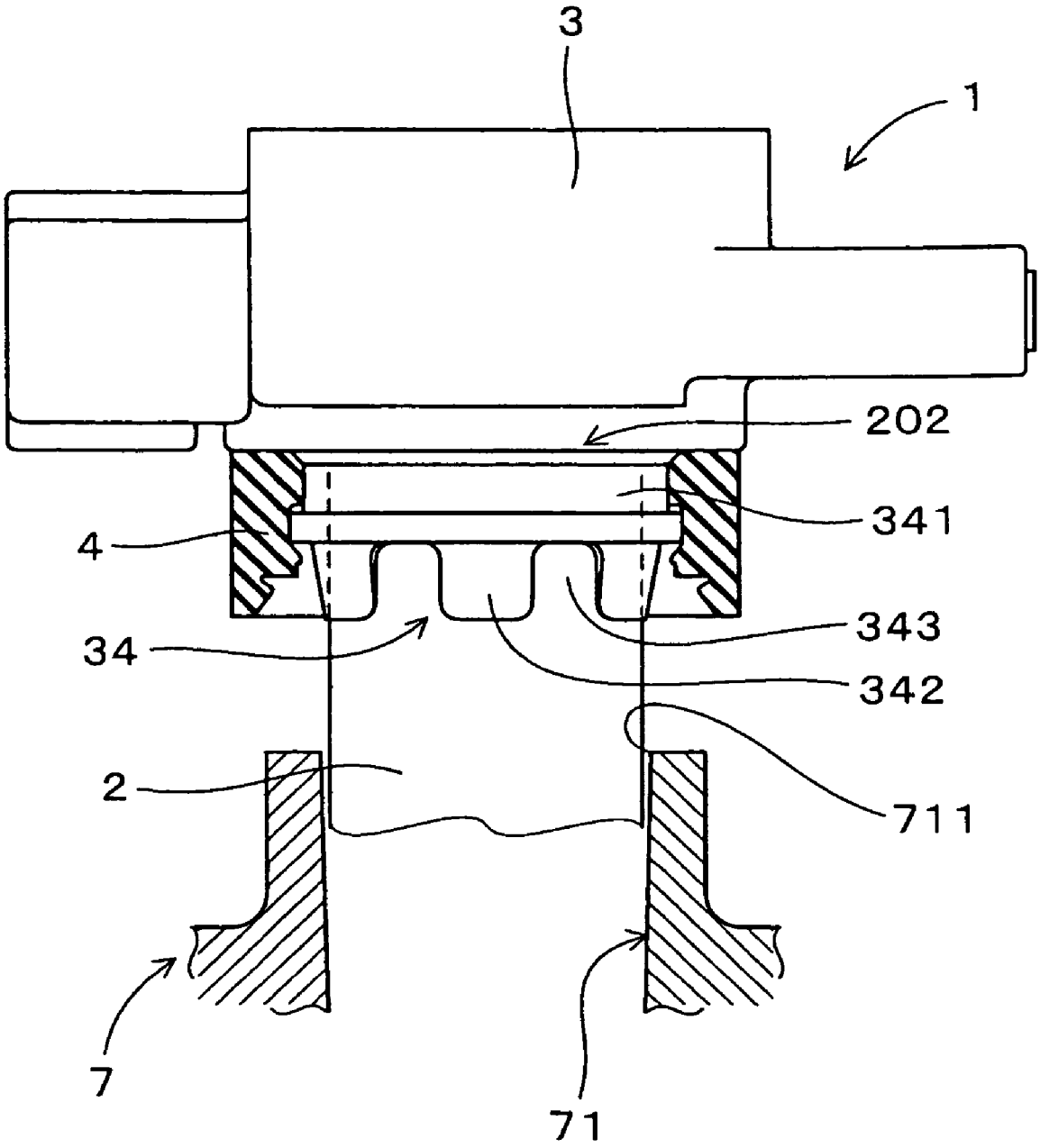
FIG. 1 is an enlarged, partially cross sectional side view showing an ignition coil having a tapered portion before being inserted into a plughole of an engine case, according to first example embodiment.
Figure 2:
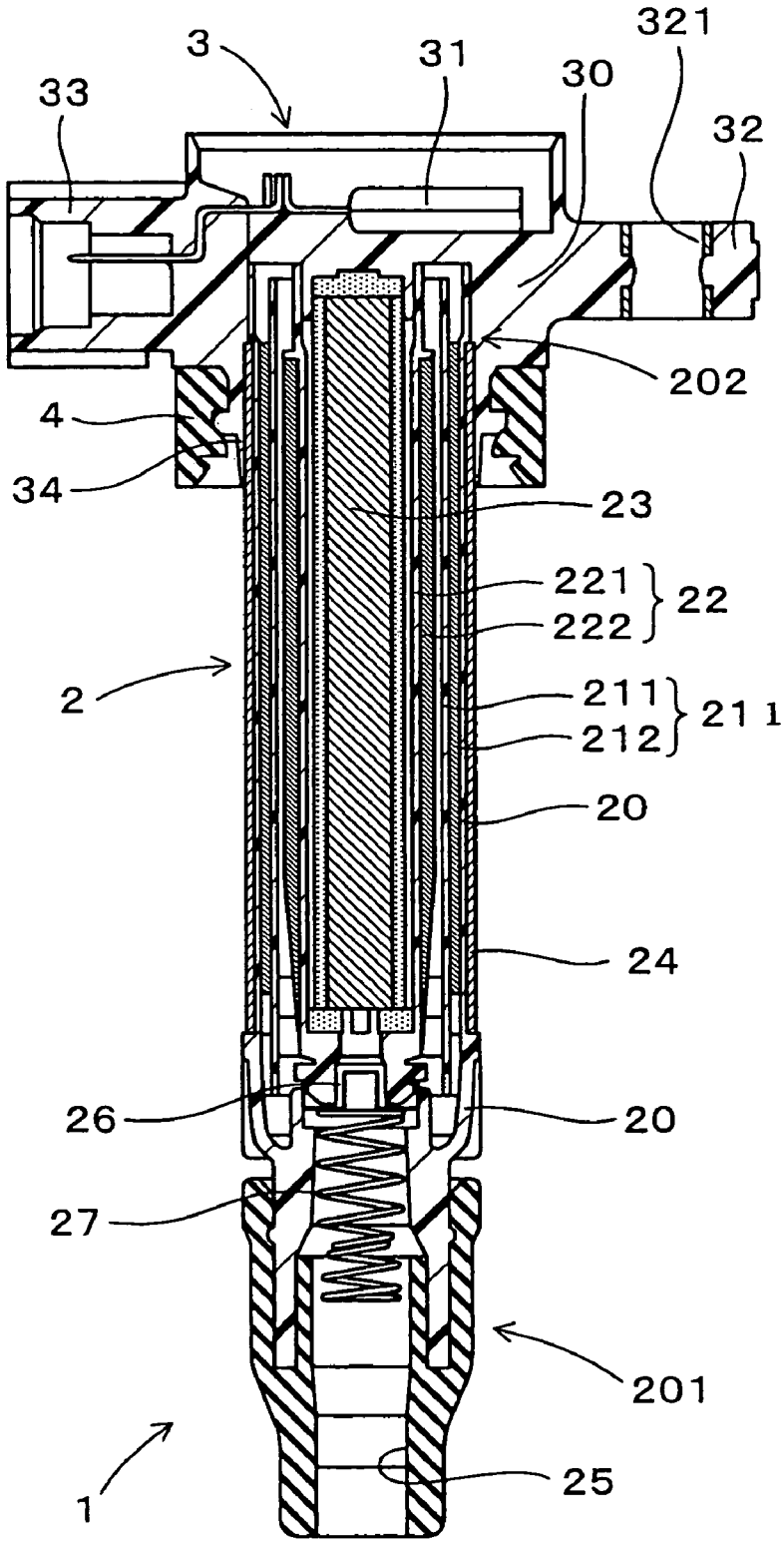
FIG. 2 is a cross sectional side view showing the ignition coil, according to the first example embodiment.
Figure 3:
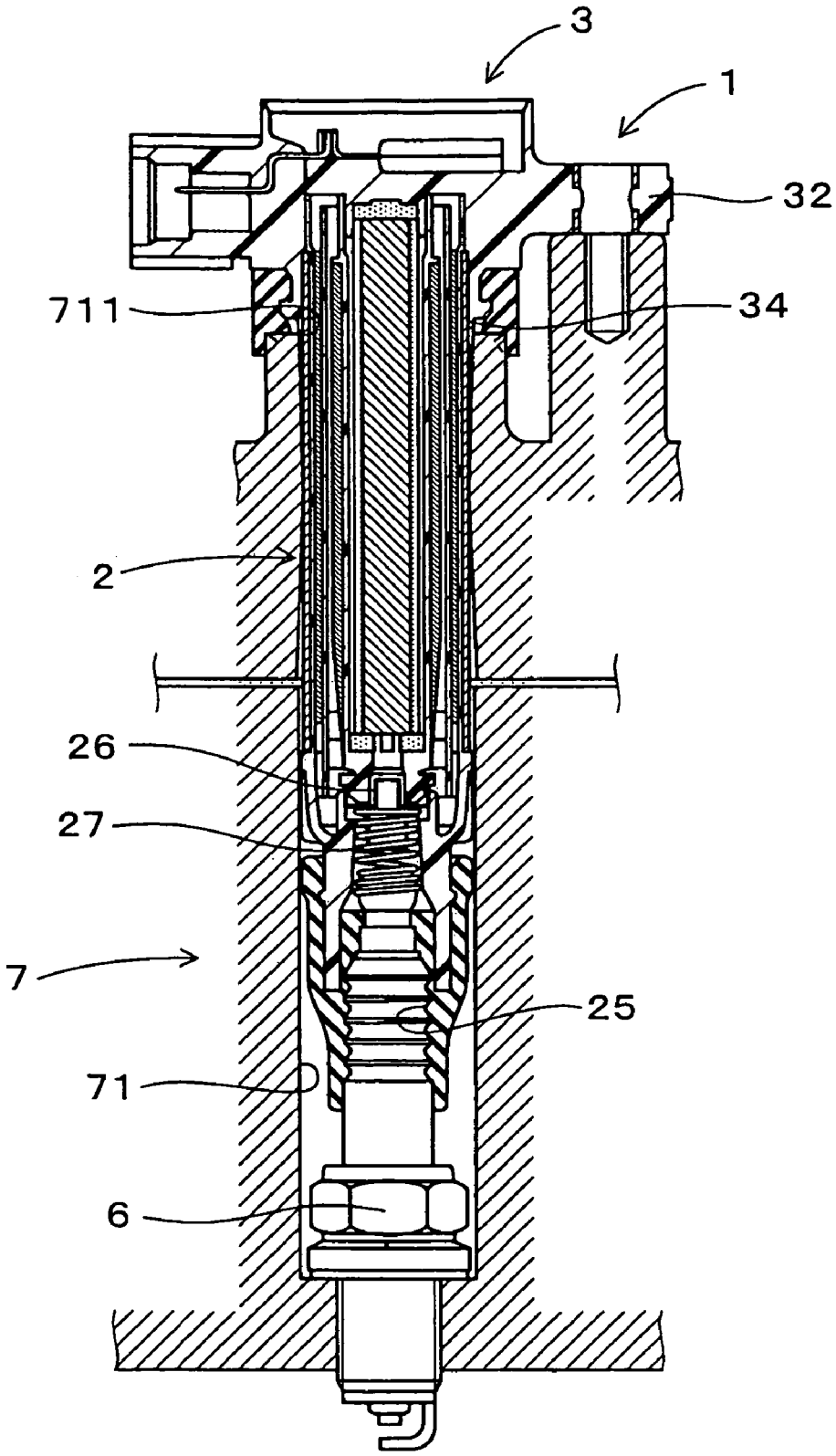
FIG. 3 is a cross sectional side view showing the ignition coil after being inserted into the plughole of the engine case, according to the first example embodiment.

As shown in FIGS. 1-3, an ignition coil 1 is electrically connected with a spark plug 6 to generate a spark in a combustion chamber of a cylinder of an internal combustion engine. The ignition coil 1 includes a cylindrical portion 2 and an igniter portion 3. The cylindrical portion 2 accommodates a primary coil 21 and secondary coil 22 that are wound coaxially to each other. The cylindrical portion 2 is inserted into a plughole 71 of an engine case 7. The cylindrical portion 2 includes an axial base portion 202 that has the igniter portion 3 as a built-in connector head portion. The igniter portion 3 includes a connecter and supplies the primary coil with electric power.

The cylindrical portion 2 includes an axial tip portion 201. The axial tip portion 201 is arranged on the end where the cylindrical portion 2 is located in the plughole 71 when the cylindrical portion 2 is inserted into the plughole 71. The axial base portion 202 is arranged on the end where the cylindrical portion 2 is not accommodated in the plughole 71 when the cylindrical portion 2 is inserted into the plughole 71.

A tapered portion 34 is attached to an outer periphery of the cylindrical portion 2. The tapered portion 34 has a shape, in which a radial thickness thereof gradually reduces to the tip end of the cylindrical portion 2 (toward the axial tip portion 201). The tapered portion 34 is mounted to an opening edge 711 of the plughole 71, whereby the cylindrical portion 2 is fixed to the plughole 71.

Next, the structure of the ignition coil 1 of the first example embodiment is described in detail.

As shown in FIG. 2, the cylindrical portion 2 is constructed of a coil case 20, into which the primary coil 21, a secondary coil 22, and a center core 23 are inserted.

Specifically, the primary coil 21 is formed of a primary wire 212, which is coated with an electrically insulative material. The primary wire 212 of the primary coil 21 is wound around the outer periphery of a primary spool 211, which has a cylindrical shape.

The secondary coil 22 is formed of a secondary wire 222, which is coated with an electrically insulative material. The secondary wire 222 of the secondary coil 22 is wound around the outer periphery of a secondary spool 221, which has a cylindrical shape. The secondary wire 222 of the secondary coil 22 is wound for a number of turns that is greater than a number of turns of the primary coil 21.

The secondary coil 22 is inserted inside the inner periphery of the primary coil 21, so that the center core 23 is arranged on the inner peripheral side of the secondary coil 22. The center core 23 is formed of electromagnetic steel plates, such as silicon steel plates, which are in a substantially stick-shape. The primary coil 21 is inserted into the cylindrical coil case 20. A metal spool 24 is attached to the outer peripheral side of the coil case 20. The metal spool 24 is formed of electromagnetic steel, such as a silicon steel plate.

The primary coil 21 is supplied with electricity, so that the primary coil 21 generates magnetic flux that passes through the center core 23 and the metal spool 24. Therefore, the magnetic flux can be amplified in the ignition coil 1.

Alternatively, the primary coil 21 is formed in the following manner without using the primary spool 211. That is, a primary wire, which is coated with an electrically insulative material, is wound to be in a cylindrical shape, subsequently the wound wire is bonded by binding medium or the like to be in a cylindrical shape.

As shown in FIG. 2, electrically insulative resin is filled in a gap formed between the center core 23 and secondary coil 22, a gap formed between the secondary coil 22 and primary coil 21, and a gap formed between the primary coil 21 and the coil case 20.

The igniter portion 3 includes an igniter case 30 and an igniter 31. The igniter case 30 is attached to the axial base portion 202. The igniter case 30 is made of resin. The igniter 31 is mounted in the igniter case 30. The igniter 31 supplies electricity to the primary coil 21. The igniter case 30 is filled with electrically insulative resin in a condition, in which the igniter 31 is set in the igniter case 30. The igniter 31 includes an electrical power control circuit and an ion current detecting circuit. The electrical power control circuit is operated by a signal transmitted from an electronic control unit (ECU). The ion current detecting circuit detects ion current flowing between electrodes of the spark plug 6.

As shown in FIGS. 2, 3, the coil case 20, at the axial tip end portion 201 of the cylindrical portion 3, has a plug mounting hole 25, into which the spark plug 6 is mounted. The plug mounting hole 25 is provided with a high voltage terminal 26 and a coil spring 27. The high voltage terminal 26 is electrically connected with one end (high voltage end) of the secondary coil 22. The coil spring 27 makes contact with the one end of the secondary coil 22 through the high voltage terminal 26.

When the ECU outputs a spark generating signal to the igniter 31, a switching element in the igniter 31 generates electricity transmitted to the primary coil 21, so that the secondary coil 22 generates induced electromotive force (counterelectromotive force) by electromagnetic induction. Thus, the spark plug 6 can generate a spark.

As shown in FIG. 2, the igniter portion 3 has a flange portion 32 and a connecter portion 33. The flange portion 32 protrudes radially outwardly with respect to the cylindrical portion 2. The flange portion 32 has a bolt insertion hole 321, through which a bolt is inserted and is screwed to the engine case 7. The connecter portion 33 protrudes radially outwardly with respect to the cylindrical portion 2. The connecter portion 33 electrically connects with an external power source.

As shown in FIG. 1, the igniter portion has a ring portion 341 which is attached to the outer periphery of the cylindrical portion 2. The ring portion 341 has an annular shape. The tapered portion 34 is formed from a plurality of taper-like portions 342, which protrude to the axial tip end portion 201. The plurality of taper-like portions 342 have a shape such that an outer diameter thereof gradually reduces to the axial tip end portion 201. The taper-like portions 342 are made of resin and are integrated into the igniter portion 3.

Figure 4:
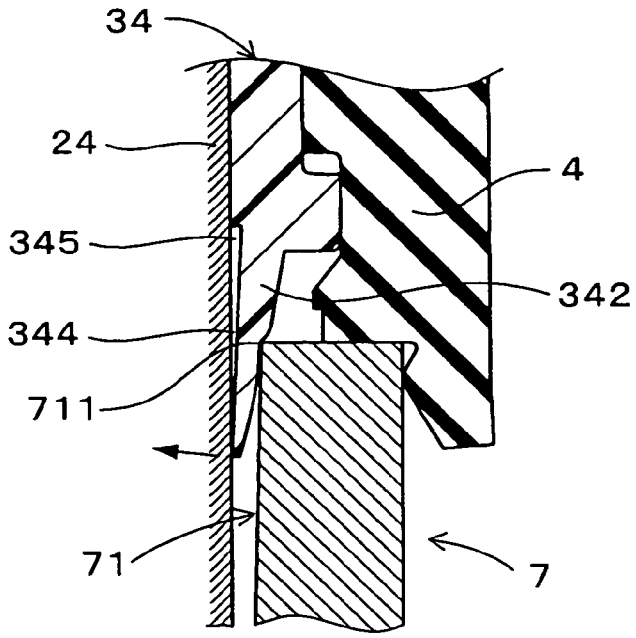
FIG. 4 is an enlarged cross sectional side view showing the ignition coil having a tapered portion after being inserted into the plughole of the engine case, according to the first example embodiment.

As shown in FIG. 4, each taper-like portion 342 is formed to have a step surface 344 on an inner peripheral side. The step surface 344 forms a space 345 between respective taper-like portion 342 and the outer peripheral surface of the cylindrical portion 2 (an outer periphery of the metal spool 24, in the first example embodiment). Each taper-like portion 342 can be tilt toward the inner peripheral side from a root portion of the step surface 344 as a pivot.

Moreover, as shown in FIG. 1, the tapered portions 34 is further formed with a plurality of notch portions 343 that are formed in the circumferential direction of the cylinder portion 2 between the taper-like portions 342. The notch portions 343 make it much easier for the taper-like portions 342 to resiliently tilt.

The cylindrical portion 2 has a sealing portion 4 that restricts water and the like from entering the plughole 71. The sealing portion 4 is attached to the outer periphery of the axial base portion 202 of the cylindrical portion 2 and is adjacent to the igniter portion 3. This sealing portion 4 is made of resin and is attached to an outer peripheral side of the tapered portion 34.

In addition, a tapered portion 34 may be separately formed from the igniter portion 3.

As shown in FIG. 4, when the ignition coil 1 is inserted into the plughole 71, the tapered outer peripheral surface of each taper-like portion 342 of the tapered portion 34 abuts on an opening edge 711 of the plughole 71. When the ignition coil 1 is further pushed in the plughole 71, a load is generated towards the inside of each taper-like portion 342. The load causes the taper-like portion 34 to deform, so that the taper-like portion 34 is locally dented at the location of the opening edge 711 of the plughole 7 (a first deformation) and is tilted toward the inner peripheral side from the root portion of the step surface 344 as a pivot (a second deformation).

The first deformation is caused by the elastic force of the material of the taper-like portion 34. On the other hand, the second deformation is produced by forming the space 345 between each taper-like portion 342 and cylindrical portion 2. Thus, the tapered portion 34 can be fully fitted to the opening edge 711 of the plughole 7 because of the first and second deformations when the ignition coil 1 is mounted to the engine case 7.

When the bolt is inserted into the flange portion 32 of the igniter portion 3, and when the ignition coil 1 is mounted to the engine case 7, a reaction force is generated by each taper-like portion 342 toward the plughole 71 in accordance with the first and second deformations of the taper-like portion 342. Thus, the ignition coil 1 is fixed to the plughole 71 without a large gap, so that the ignition coil 1 can be restricted from vibrating and abrasion, even when an external force, such as vibration from the engine, is applied to the ignition coil 1.

An amount of deformation of the outer diameter of the tapered portion 34 can be also changed to fit the opening edge 711 of the plughole 71, so that the cylindrical portion 2 can be fixed to a variety of plugholes 71 of different inner diameters. Thus, it can restrict forming a gap between the plughole 71 and the cylindrical portion 2, so that the cylindrical portion 2 can be stably mounted to the plughole 71, even when the cylindrical portion 2 is inserted to a variety of plugholes 71 with different inner diameters.

According to the ignition coil of the first example embodiment of FIGS. 1-4, the cylindrical portion 2 can be also fixed to a variety of plugholes 71 of different inner diameters, without a large gap between the cylindrical portion 2 and the plughole 71.

Figure 5:
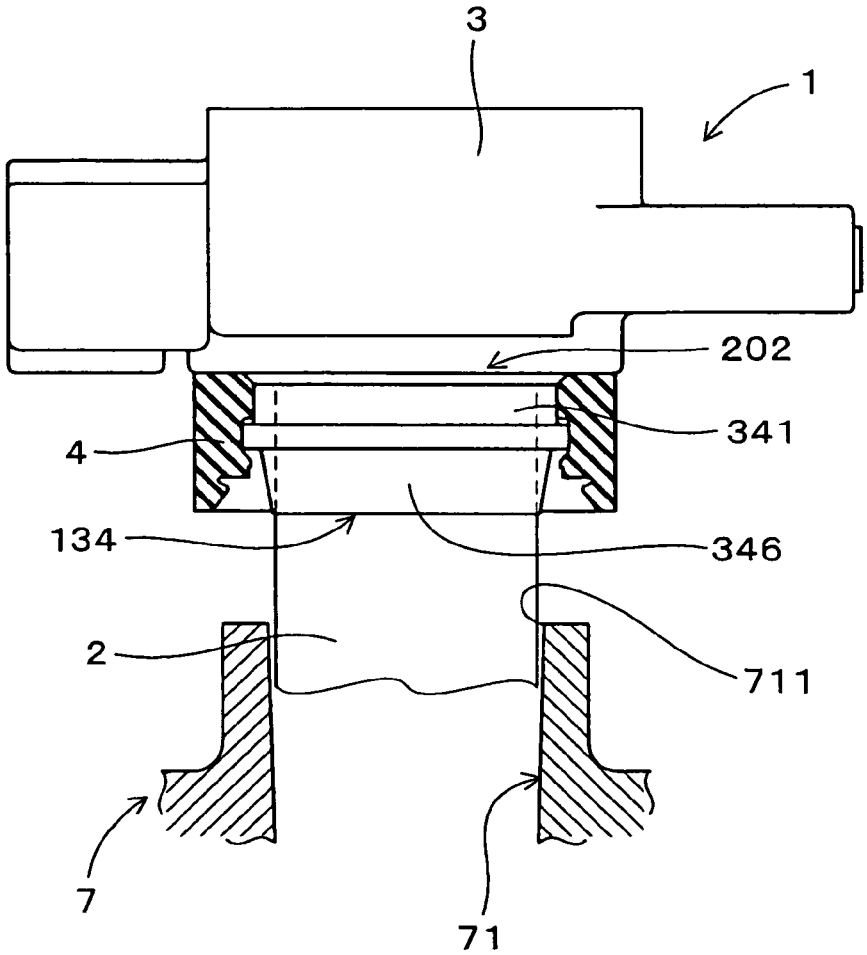
FIG. 5 is a partially cross sectional side view showing an ignition coil having a first modification of the tapered portion before being inserted into the plughole of the engine case, according to the first example embodiment.

A modification of the first example embodiment is illustrated in FIG. 5. As shown in FIG. 5, a tapered portion 134 may be formed of a taper-like ring portion 346, in which the thickness thereof reduces in the direction to the axial tip end portion 201, without the notch portions. According to this modification of the first example embodiment, although it is more difficult to deform the taper-like ring portion 346, a certain force, which the taper-like ring portion 346 receives from the opening edge 711 of the plug hole 71, can become large. Thus, the ignition coil 1 can be further restricted from vibrating and abrasion.

Figure 6:
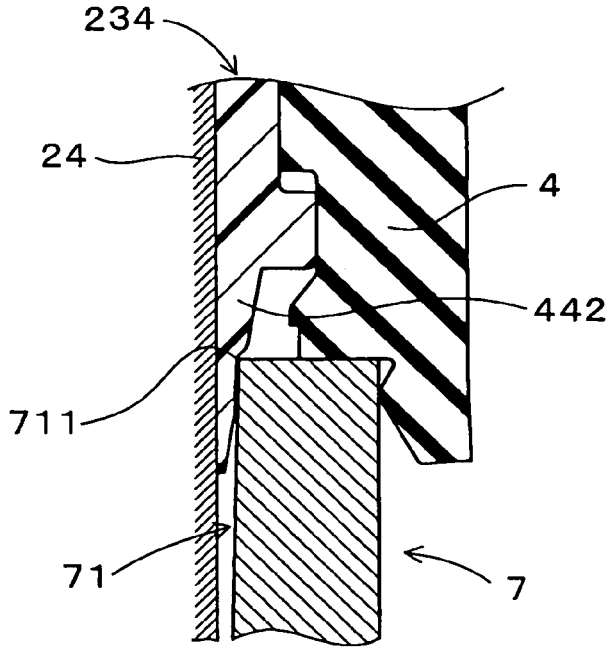
FIG. 6 is an enlarged cross sectional side view showing an ignition coil having a second modification of the tapered portion after being inserted into the plughole of the engine case, according to the first example embodiment.

As a further alternative, the space 345 of FIG. 4 between each of taper-like portion 342 and the outer periphery of the cylindrical portion 2 may not be formed. As shown in FIG. 6, each of taper-like portion 442 of a tapered portion 234 is formed to almost contact with the outer periphery of the cylindrical portion 2.

In a second modification of the first example embodiment, though each of taper-like portion 342 is hardly tilted, the taper-like portions 342 are locally dented at the location of an opening edge 711 of a plughole 7. Thus, an ignition coil 1 can be fixed to the plughole 7 without an gap. Moreover, a molding die for the tapered portion 34 can also be simplified.

Figure 7:
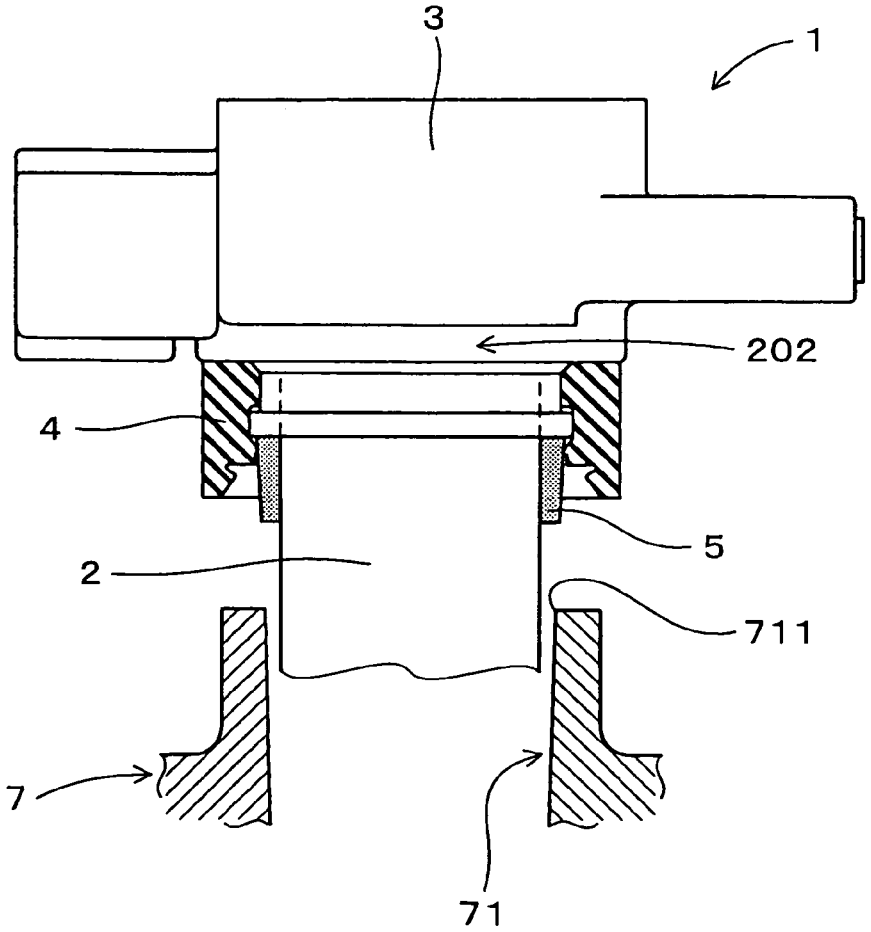
FIG. 7 is a partially cross sectional side view showing an ignition coil having an elastic portion according to second example embodiment.

In a second example embodiment, as shown in FIG. 7, an ignition coil 1 includes an elastic portion 5 on an outer periphery of an cylindrical portion 2, instead of integrating a tapered portion 34 with the igniter portion 3 as shown in FIGS. 1-6. The elastic portion 5 is capable of elastic deformation.

The elastic portion 5 can change its outer diameter by being fitted to a plughole 71. Thus, the cylindrical portion 2 is fixed to the plughole 71.

The elastic portion 5 is attached to the outer periphery of the cylindrical portion 2 and is adjacent to an igniter portion 3. The elastic portion 5 is fitted to an open edge 711 of the plughole 71.

Figure 8:
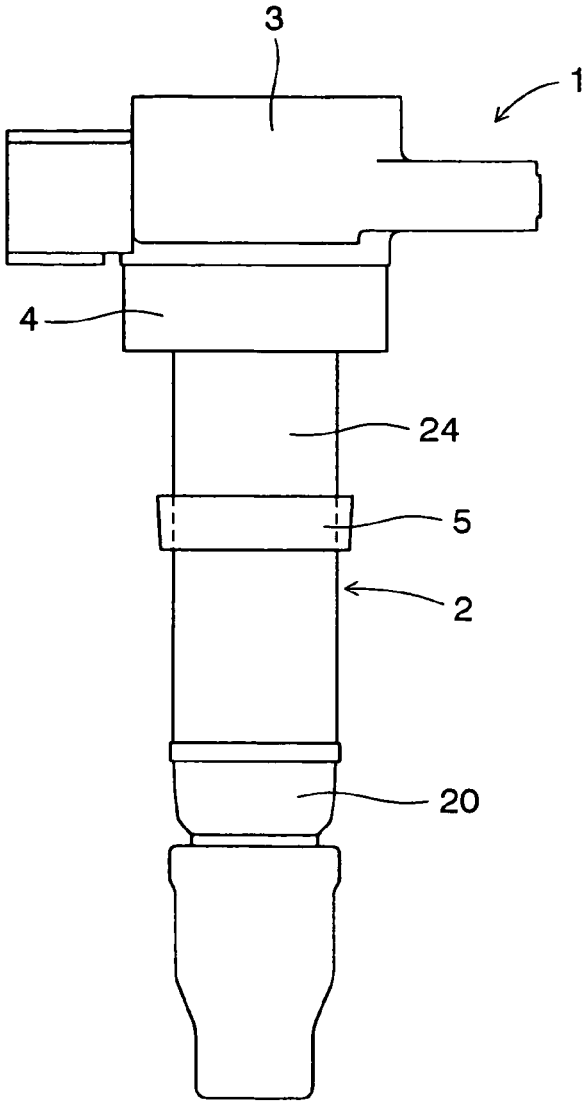
FIG. 8 is a side view showing an ignition coil having a modification of the elastic portion according to the second example embodiment.

Alternatively, as shown in FIG. 8, the elastic portion 5 can be attached on the outer periphery of an intermediate portion of a cylindrical portion 2 (a metal spool 24) in a modification of the second example embodiment, so that the elastic portion 5 may be inserted and be fit to the inner peripheral side of the plughole 71.

Moreover, the elastic portion 5 in FIGS. 7, 8 is an elastic body 5 on the outer periphery of the cylindrical portion 2. The elastic body 5 is formed of rubber material that is capable of elastic deformation. The elastic body 5 can change the amount of elastic deformation, when the cylindrical portion 2 is inserted into the inner open edge 711 of the plughole 71.

In addition, the elastic portion 5 in FIGS. 7, 8 can change its outer diameter, when the cylindrical portion 2 is inserted into the inner open edge 711 of the plughole 71. Therefore, the elastic portion 5 can change the amount of elastic deformation, and then can change its outer diameter according to an inner diameter of the plughole 71, even when the cylindrical portion 2 of the ignition coil 1 is inserted to a variety of plugholes 71 of different inner diameters. Thus, it can restrict forming a gap between the plughole 71 and the cylindrical portion 2, so that the cylindrical portion 2 can be stably mounted to the plughole 71, even when the cylindrical portion 2 is inserted to a variety of plugholes 71 of different inner diameters.

Therefore, according to the ignition coil 1 of the second example embodiment (FIG. 7 and FIG. 8), the cylindrical portion 2 can also be fixed to a variety of plugholes 71 of different inner diameters, without a large gap between the cylindrical portion 2 and the plughole 71.

In the second example embodiment, structures other than the above elastic portion may be equivalent to that in the first embodiment.

Figure 9:
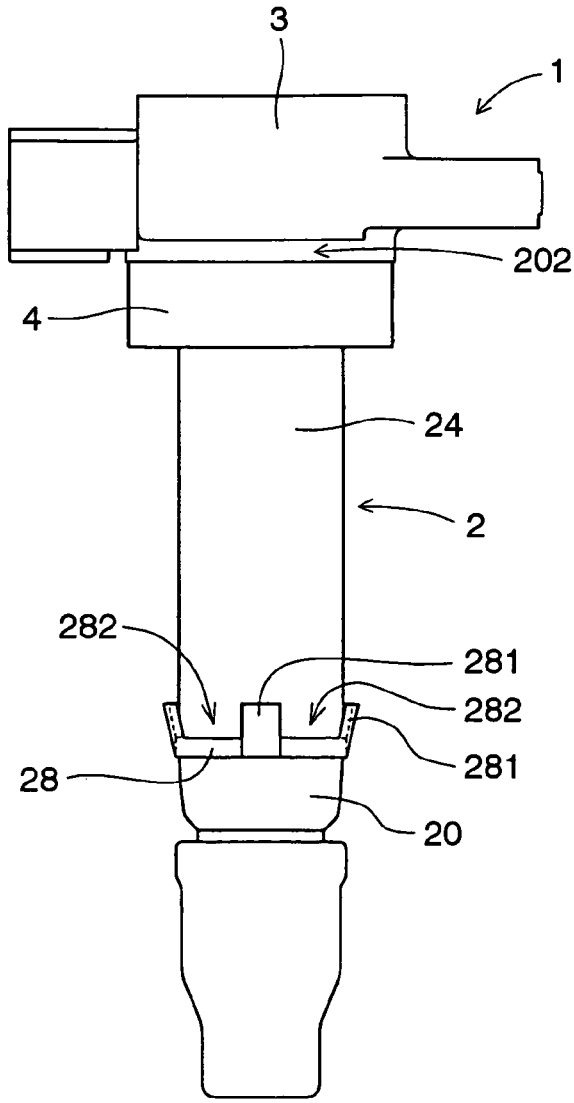
FIG. 9 is a sideview showing an ignition coil having a projection piece according to third example embodiment.

A third example embodiment is shown in FIG. 9. As illustrated therein, an elastic projection piece 28 is provided on an outer periphery of a cylindrical portion 2. The projection piece 28 has projection portions 281 protruding outwardly and towards an axial base portion 202 of the cylindrical portion 2 from a vicinity of the coil case 20. The projection piece 28 can change the amount of tilting thereof, when the cylindrical portion 2 is inserted into a plughole (not shown in FIG. 9).

The projection piece 28 has a plurality of notch portions 282 that are formed in the circumferential direction of the projection piece 28 among the projection portions 281.

Figure 10:
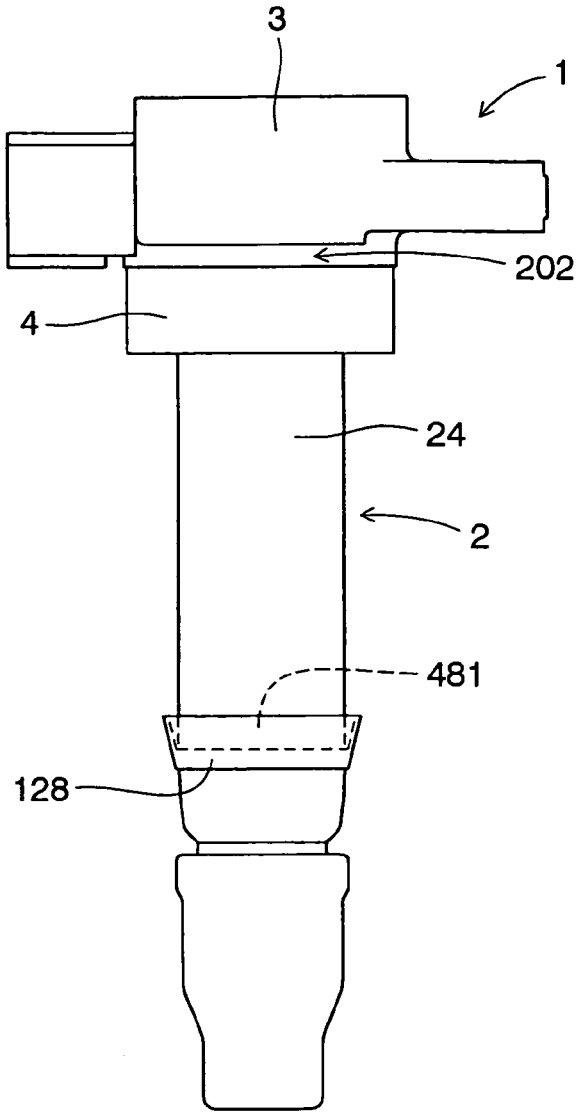
FIG. 10 is a side view showing an ignition coil having a modification of the projection piece according to the third example embodiment.

On the other hand in a modification of the third example embodiment, as shown in FIG. 10, the projection piece 128 can also be formed in the ring form which is protruded and tilted outward as a flexible skirt 481, without forming the plurality of notch portions 282.

In the third example embodiment of FIGS. 9, 10, the projection piece 28, 128 can change the amount of tilting thereof according to an inner diameter of the plughole, even when the cylindrical portion 2 of the ignition coil 1 is inserted to a variety of plugholes of different inner diameters. Therefore, it can restrict forming a gap between the plughole and the cylindrical portion 2.

In the third example embodiment, structures other than the above projection piece may be equivalent to that in the first embodiment.

Figure 11:
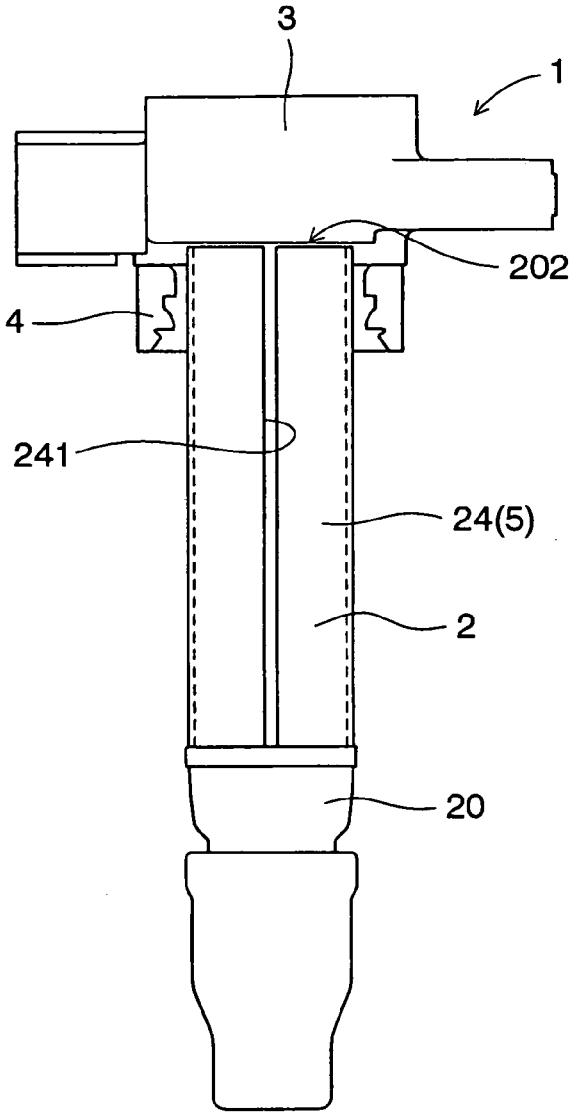
FIG. 11 is a side view showing an ignition coil having a metal spool according to fourth example embodiment.

A fourth example embodiment is shown in FIG. 11. As illustrated therein, an elastic metal spool 24 is attached to an outer periphery of a cylindrical portion 2. The metal spool 24 has a slit 241 in an axial direction of the cylindrical portion 2. The metal spool 24 can change its outer diameter, when the cylindrical portion 2 is inserted into a plughole (not shown).

The slit 241 is formed to slit a part of the cylindrical portion 2 from one end to the other end in axial direction of the cylindrical portion 2. The metal spool 24 can change its outer diameter by reducing the width of the slit 241, according to an inner diameter of the plughole, even when the cylindrical portion 2 of the ignition coil 1 is inserted to a variety of plugholes of different inner diameters. Therefore, it can restrict forming a gap between the plughole and the cylindrical portion 2.

In the fourth example embodiment, structures other than the above projection piece can be equivalent to that in the first embodiment.

The present invention should not be limited to the disclosed example embodiments, but may be implemented in other ways without departing from the spirit of the aspect.

What is claimed is:

1. An ignition coil comprising:

a cylindrical portion that includes a primary coil and a secondary coil, the secondary coil being wound coaxially with respect to the primary coil;

wherein the cylindrical portion is capable of being inserted into a plughole of an engine case of an internal combustion engine, the cylindrical portion has a base end in an axial direction of the cylindrical portion, the base end of the cylindrical portion has a built-in connector head portion that supplies the primary coil with electric power, the cylindrical portion has an elastically deformable outer peripheral portion, the outer peripheral portion changes an outer diameter thereof when the outer peripheral portion fits to the plughole, whereby the cylindrical portion is fixed to the plughole, and the outer peripheral portion has a step surface on an inner peripheral side thereof.

2. The ignition coil according to claim 1, wherein the outer peripheral portion has a ring shape.

3. The ignition coil according to claim 1, wherein the outer peripheral portion has a ring portion and a plurality of projection portions, and the plurality of projection portions protrude from the ring portion in an axial direction of the cylindrical portion.

4. The ignition coil according to claim 3, wherein at least two of the plurality of projection portions have a space therebetween in a circumferential direction of the cylindrical portion.

5. The ignition coil according to claim 1, wherein the outer peripheral portion has a ring portion and a projection portion, the projection portion protrudes from the ring portion in an axial direction of the cylindrical portion, and the projection portion is continuously formed in a circumferential direction of the cylindrical portion.

6. The ignition coil according to claim 1, wherein the outer peripheral portion is an elastic body disposed on an outer periphery of the cylindrical portion, and the elastic body changes an amount of elastic deformation thereof by being fitted to the plughole, whereby the cylindrical portion is fixed to the plughole.

7. The ignition coil according to claim 1, wherein the outer peripheral portion includes a projection piece on an outer periphery of the cylindrical portion, the projection piece includes at least one projection portion outwardly protruding and tilting to the base end of the cylindrical portion, and the projection portion changes an amount of tilting thereof by being fitted to the plughole, whereby the cylindrical portion is fixed to the plughole.

8. The ignition coil according to claim 1, wherein the cylindrical portion includes a metal spool disposed as an outer peripheral portion surrounding the primary and secondary coils, the metal spool has a slit in an axial direction thereof, thereby to define the elastically deformable outer peripheral portion, and the metal spool changes the outer diameter thereof by being fitted to the plughole, whereby the cylindrical portion is fixed to the plughole.

9. The ignition coil according to claim 1, wherein the step surface forms a space between the outer peripheral portion and an outer peripheral surface of the cylindrical portion.

10. The ignition coil according to claim 9, wherein the outer peripheral portion is capable of being tilted toward an inner peripheral side from a root portion of the step surface as a pivot.

11. An ignition coil comprising:

a cylindrical portion that includes a primary coil and a secondary coil, the secondary coil being wound coaxially with respect to the primary coil, wherein the cylindrical portion is capable of being inserted into a plughole of an engine case of an internal combustion engine;

the cylindrical portion has a base end and a tip end, respectively, in an axial direction of the cylindrical portion, the base end of the cylindrical portion has a built-in connector head portion that supplies the primary coil with electric power, the cylindrical portion has a tapered portion on an outer periphery thereof, the tapered portion has a shape, in which a thickness thereof reduces to the tip end of the cylindrical portion, the tapered portion of the cylindrical portion is capable to fit to an opening edge of the plughole, whereby the cylindrical portion is fixed to the plughole, and the tapered portion has a step surface on an inner peripheral side thereof.

12. The ignition coil according to claim 11, wherein the built-in connector head portion of the base end of the cylindrical portion has an annular ring portion defining the tapered portion on the outer periphery of the cylindrical portion.

13. The ignition coil according to claim 12, wherein the built-in connector head portion has an igniter with an electric supply control circuit.

14. The ignition coil according to claim 11, wherein the tapered portion includes a plurality of taper-like portions, and the plurality of taper-like portions outwardly protrude to the tip end of the cylindrical portion.

15. The ignition coil according to claim 14, wherein each of the plurality of taper-like portions has a step formed on an inner peripheral side thereof, and each of the plurality of taper-like portions and the cylindrical portion form a space therebetween.

16. The ignition coil according to claim 11, wherein the step surface forms a space between the tapered portion and an outer peripheral surface of the cylindrical portion.

17. The ignition coil according to claim 16, wherein the tapered portion is capable of being tilted toward an inner peripheral side from a root portion of the step surface as a pivot.

* * * * *